US011787684B2

(12) United States Patent
Truby et al.

(10) Patent No.: US 11,787,684 B2
(45) Date of Patent: Oct. 17, 2023

(54) DEVICE FOR A TOUCH-FREE OPERATION OF A FUEL PUMP NOZZLE

(71) Applicants: Joshua Truby, Houston, TX (US); Lane H. Truby, Houston, TX (US)

(72) Inventors: Joshua Truby, Houston, TX (US); Lane H. Truby, Houston, TX (US)

( * ) Notice: Subject to any disclaimer, the term of this patent is extended or adjusted under 35 U.S.C. 154(b) by 160 days.

(21) Appl. No.: 17/518,856

(22) Filed: Nov. 4, 2021

(65) Prior Publication Data

US 2023/0140355 A1 May 4, 2023

(51) Int. Cl.
*B67D 7/42* (2010.01)

(52) U.S. Cl.
CPC ..... *B67D 7/421* (2013.01)

(58) Field of Classification Search
CPC .. B67D 7/421; B67D 7/42; B67D 7/04; F16B 2/02; F16B 2/10; B65D 65/22
See application file for complete search history.

(56) References Cited

U.S. PATENT DOCUMENTS 5,271,560 A * 12/1993 De Winter ..... A47K 5/1202 239/42
2009/0056844 A1* 3/2009 Schanz ..... B67D 7/42 141/392
2017/0241456 A1* 8/2017 Tuthill ..... F16B 5/0607
2018/0079639 A1* 3/2018 Byrne ..... B67D 7/42
2020/0268219 A1* 8/2020 Yeo ..... B67D 7/426

* cited by examiner

*Primary Examiner* — Grant Moubry
*Assistant Examiner* — James G Moubry
(74) *Attorney, Agent, or Firm* — Madan Law PLLC

(57) ABSTRACT

An apparatus includes a cover forming an open channel that includes a curved grip portion and first and second sides extending from the curved grip portion. The channel is receivable onto a fuel pump handle of a fuel pump nozzle such that the curved grip portion fits closely over the fuel pump handle and the sides extend downwardly along opposing sides of the fuel pump handle. The apparatus further includes a trigger guard including a first end connected to the first side of the cover by a hinge and a second end that is selectively connectable to the second side of the cover. The trigger guard is rotatable about the hinge from an open position to a closed position in which the trigger guard extends under a fuel pump trigger of the fuel pump nozzle and the second end is connected to the second side.

20 Claims, 6 Drawing Sheets

DEVICE FOR A TOUCH-FREE OPERATION OF A FUEL PUMP NOZZLE

BACKGROUND

The present disclosure relates to an apparatus for operation of a fuel pump nozzle to dispense fuel into a vehicle or container without touching the fuel pump nozzle.

BACKGROUND OF THE RELATED ART

Automobiles provide an important mode of transportation for individuals and businesses. Automobiles enable an individual to travel to their place of work, a favorite retail establishment or restaurant, their kid's school events, the homes of friends and family, a medical facility, a vacation destination, and almost anywhere the individual desires to go. Work vehicles, such as delivery vans, construction vehicles, buses, and public service vehicles, are similarly important to the performance of critical services and the functioning of the entire economy. For any of the foregoing types of activities, the operation of an automobile is a common activity for many individuals. In fact, many individuals will operate an automobile multiple times in a week or even in a single day.

An important responsibility of an individual operating an automobile is to verify that the automobile has enough fuel to reach a chosen destination or to complete a desired objective. For example, the individual may determine whether the automobile's fuel gauge indicates that the automobile's fuel tank contains enough fuel to reach the destination or complete the objective. It is a common occurrence that the individual will need to add fuel to the fuel tank of the automobile before or during a given outing to prevent running out of fuel and becoming unable to proceed or return.

Due to the regular need to obtain additional fuel at various points in a journey, fuel stations are conveniently located along commonly used roadways. The individual may simply drive their automobile up to the side of a fuel pump, provide a form of payment, and pump fuel into the automobile's fuel tank without much delay. In fact, the operation of the fuel pump and the fuel dispensing nozzle is substantially standardized for safety and practicality. After inputting a form of payment and selecting a fuel type, the individual simply grasps the fuel nozzle by a handle, lifts the fuel nozzle from a hook on the pump housing, inserts the end of the fuel nozzle into the fuel tank filler pipe, and manually actuates a trigger that is adjacent to the handle.

Filling an automobile with fuel is not a difficult task, but it is a manual process that requires grasping the handle and trigger areas of the fuel nozzle. Unfortunately, a given fuel nozzle may be used by many individuals every day and the fuel nozzle may become dirty with grease and grime and/or contaminated with germs, viruses, or hazardous materials. The individual that operates the fuel nozzle may get one hand or both hands dirty or contaminated during this common and regular task. A hand washing facility might be provided inside a fuel station building adjacent to the fuel pump area, but many individuals may prefer to avoid going inside or may prefer to simply avoid putting their hands in contact with a dirty or contaminated fuel nozzle.

BRIEF SUMMARY

Some embodiments provide an apparatus comprising a cover forming an open channel that includes a curved grip portion and first and second sides extending from the curved grip portion. The open channel is receivable onto a fuel pump handle of a fuel pump nozzle such that the curved grip portion fits closely over a top surface of the fuel pump handle and the first and second sides extend downwardly along opposing sides of the fuel pump handle. The apparatus further comprises a trigger guard including a first end that is connected to the first side of the cover by a hinge and a second end that is selectively connectable to the second side of the cover. The trigger guard is rotatable about the hinge from an open position in which the second end is disconnected from the second side to a closed position in which the trigger guard extends under a fuel pump trigger of the fuel pump nozzle and the second end is connected to the second side.

Some embodiments provide an apparatus comprising a cover forming an open channel that includes a curved grip portion and first and second sides extending from the curved grip portion. The open channel is receivable onto a fuel pump handle of a fuel pump nozzle such that the curved grip portion fits closely over a top surface of the fuel pump handle and the first and second sides extend downwardly along opposing sides of the fuel pump handle. The apparatus further comprises a trigger guard including a first end that is connected to the first side of the cover by a hinge and a second end that is selectively connectable to the second side of the cover. The trigger guard is rotatable about the hinge from an open position in which the second end is disconnected from the second side to a closed position in which the trigger guard extends under a fuel pump trigger of the fuel pump nozzle and the second end is connected to the second side. Furthermore, the second end of the trigger guard includes a first latch member and the second side of the cover includes a second latch member, wherein the first and second latch members selectively connect the second end of the trigger guard to the second side of the cover. The first and second latch members disconnect under a force of the fuel pump trigger being released in response to the fuel pump nozzle being automatically shut off.

DETAILED DESCRIPTION

Figure 1A:
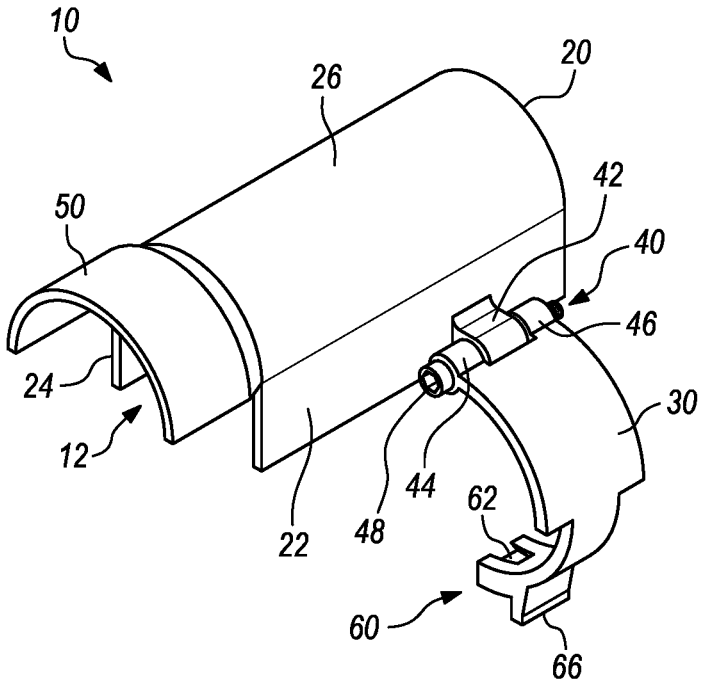
FIG. 1A is a top-angled, right-hand side perspective view of an apparatus.

Some embodiments provide an apparatus comprising a cover forming an open channel that includes a curved grip portion and first and second sides extending from the curved grip portion. The open channel is receivable onto a fuel pump handle of a fuel pump nozzle such that the curved grip portion fits closely over a top surface of the fuel pump handle and the first and second sides extend downwardly along opposing sides of the fuel pump handle. The apparatus further comprises a trigger guard including a first end that is connected to the first side of the cover by a hinge and a second end that is selectively connectable to the second side of the cover. The trigger guard is rotatable about the hinge from an open position in which the second end is disconnected from the second side to a closed position in which the trigger guard extends under a fuel pump trigger of the fuel pump nozzle and the second end is connected to the second side.

The cover and trigger guard may each be independently formed with many common plastic compositions, such as polyester. One suitable polyester is referred to as polylactic acid (PLA). Accordingly, the cover may be a substantially rigid and strong component but may have a small range of flexibility as afforded by the plastic. The plastic may include any suitable polymers, such as nylon, acrylic, polystyrene, and polyvinyl chloride, with or without additives, such as colorants, fillers, reinforcing fibers, plasticizers, stabilizers and the like. Other suitable thermoplastics may also be used. The cover and/or trigger guard may be manufactured using various technologies, such as using three-dimension printing or injection molding. Furthermore, the cover and trigger guard may be coating with materials having various desirable properties, such as an antimicrobial coating.

Some embodiments of the cover include an open channel that is a substantially U-shaped channel. During use, the open end of the U-shaped channel is directed over the fuel pump handle until the fuel pump handle reaches the base of the U-shape channel with the sides of the U-shaped channel extending along the sides of fuel nozzle. For example, the open channel may have an interior surface that is complementary to the top surface of the fuel pump handle.

The trigger guard is rotationally coupled to the cover with a hinge. The first end of the trigger guard may form one half of the hinge and the first side of the cover may form another half of the hinge. For example, the hinge may be a barrel hinge with one or more sections of the barrel formed at the first end of the trigger guard and one or more section of the barrel formed by or secured to the first side of the cover. The sections of the barrel may be aligned and a hinge pin or element, such as a bolt or screw and nut, may be secured through all of the barrel sections to securely couple the trigger guard to the cover and define an axis of rotation therebetween.

In some embodiments, an individual may rotate the trigger guard about the hinge and until the trigger guard extends under the fuel nozzle trigger. Furthermore, rotation of the trigger guard may then cause the fuel nozzle trigger to rise toward the fuel nozzle handle and initiate dispensing of fuel from the fuel nozzle into the fuel tank of the automobile. In some options, the trigger guard may be further rotated so that a second end of the trigger guard may be engage the second side of the cover. The second end of the trigger guard may include a first latch member and the second side of the cover may include a second latch member, such that the first and second latch members may selectively connect the second end of the trigger guard to the second side of the cover. Accordingly, the trigger guard may be "latched" or otherwise "secured" in a closed position. The use of such selectively connectable latch members may enable hands-free dispensing of fuel into the fuel tank.

In some embodiments, the cover and the trigger guard are both sufficiently rigid that rotation of the trigger guard about the hinge from the open position toward the closed position aligns the first latch member with the second latch member for engagement therebetween. The automatic alignment of the first second latch members simplifies latching of the trigger guard in the closed position and reduces the level of hand and finger dexterity required of the individual. A wide variety of latching mechanisms may be incorporated but are preferably simple frictional connections or catches.

In some embodiments, the first latch member may be a slot formed in the second end of the trigger guard and the second latch member may be a tab formed on the second side of the cover, wherein the slot is selectively connectable to the tab by slidably engaging the slot about the tab. The size and shape of the slot and tab may vary so long as a releasable connection is formed. In one example, the slot and tab have complementary dovetail shapes. In a further option, the slot may be formed on the second side of the cover and the tab may be formed on the second end of the trigger guard. Furthermore, the slot and/or the tab may be tapered to facilitate entry of the tab into the slot or to provide a gradual increase in frictional engagement between the tab and slot.

In some embodiments, engagement of the slot about the tab results in static friction between the slot and tab to resist disengagement of the second end of the trigger guard from the second side of the cover. In one option, the amount of the static friction between the slot and the tab may be sufficient to secure the trigger guard in a closed position during hands-free operation of the fuel pump nozzle, yet the amount of the static friction between the slot and the tab may be overcome by a force of the fuel pump trigger being released in response to the fuel pump nozzle being automatically shut off.

In some embodiments, the second end of the trigger guard may further include a latch release tab that extends laterally away from the fuel pump nozzle with the trigger guard in the closed position. The latch release tab is preferably positioned for operation with a user's thumb when the user is gripping the cover. Specifically, the individual's palm may rest against the cover with the four fingers extending along the right-hand side of the cover to engage the trigger guard and the thumb may extend along the left-hand side of the cover. With the latch release tab on the left-hand side of the cover, the thumb can be easily moved into a position to push the latch release tab and cause disengagement of the latch members. It should be recognized that the foregoing discussion describes a right-handed apparatus and it is possible to form a left-handed apparatus that is a mirror image of any of the right-handed embodiments described herein. Accordingly, some embodiments may include a hinge on the left-hand side of the cover and a latch member on the right-hand side of the cover.

Some embodiments may be characterized in that a user may temporarily position the cover over the fuel pump handle and cause the trigger guard to actuate the fuel pump trigger without touching any portion of the fuel pump handle and the fuel pump trigger. Specifically, the individual's hand only contacts the outer surfaces of the cover and trigger guard while only the inner surfaces of the cover and trigger guard only contact the pump nozzle hand and trigger. The width of the trigger guard may be increased to allow a greater number of fingers of the individual's hand to be used in rotating the trigger guard to cause actuation of the fuel nozzle trigger and/or latching of the trigger guard. Furthermore, the individual may further return the fuel pump nozzle to a stowed position on the fuel pump and remove the cover from the fuel pump handle with the trigger guard in the open position, yet still avoid touching any portion of the fuel pump nozzle.

Some embodiments may be characterized in that a user may, with a single hand, position the cover over the fuel pump handle and cause the trigger guard to actuate the fuel pump trigger without touching any portion of the fuel pump handle and the fuel pump trigger. Single-handed operation of the fuel pump nozzle using the apparatus is not necessary but may be helpful to the individual whose current practice is to use only one hand for this purpose.

In some embodiments, the apparatus may further include a wrist guard extending from a proximal end of the rigid cover and covering a portion of the fuel pump nozzle that is proximal of the fuel pump handle. The wrist guard may be useful to further protect the individual's wrist or sleeve from contacting the fuel pump nozzle. In addition, the wrist guard may also serve a helpful alignment purpose to assist the individual in positioning and seating the cover over the handle portion of the fuel pump nozzle. The wrist guard may be integrally formed with the cover but may or may not extend along the sides of the fuel pump nozzle as does the cover.

In some embodiments, the cover may have an outward-directed surface that is textured or coated to improve a grip of a user's hand on the cover. Similarly, an outward-directed surface of the trigger guard may be textured or coated.

Some embodiments provide an apparatus comprising a cover forming an open channel that includes a curved grip portion and first and second sides extending from the curved grip portion. The open channel is receivable onto a fuel pump handle of a fuel pump nozzle such that the curved grip portion fits closely over a top surface of the fuel pump handle and the first and second sides extend downwardly along opposing sides of the fuel pump handle. The apparatus further comprises a trigger guard including a first end that is connected to the first side of the cover by a hinge and a second end that is selectively connectable to the second side of the cover. The trigger guard is rotatable about the hinge from an open position in which the second end is disconnected from the second side to a closed position in which the trigger guard extends under a fuel pump trigger of the fuel pump nozzle and the second end is connected to the second side. Furthermore, the second end of the trigger guard includes a first latch member, and the second side of the cover includes a second latch member, wherein the first and second latch members selectively connect the second end of the trigger guard to the second side of the cover. The first and second latch members disconnect under a force of the fuel pump trigger being released in response to the fuel pump nozzle being automatically shut off. Optionally, the apparatus may be characterized in that an individual user may, without touching any portion of the fuel pump handle and the fuel pump trigger, temporarily position the cover over the fuel pump handle, cause the trigger guard to actuate the fuel pump trigger, and remove the cover from the fuel pump handle with the trigger guard in the open position.

FIG. 1A is a top-angled, right-hand side perspective view of an apparatus 10. The apparatus 10 includes a cover 20, a trigger guard 30 coupled to the cover 20 with a hinge 40, and a wrist guard 50 extending from a proximal end of the cover 20. The cover 20 forms an open channel 12 (also shown in FIG. 1B), which is illustrated as a downwardly open channel or inverted U-shaped cover. The hinge 40 is formed with one barrel section 42 that is secured to a first side 22 and with two barrel sections 44, 46 that are secured to a first end of the trigger guard 30. The barrel sections 42, 44, 46 each have a hole therethrough and are aligned so receive a hinge pin 48 through each hole.

The trigger guard 30 is illustrated as an arced member that curved out and down from the hinge 40. A second end of the trigger guard 30 forms a first latch member 60 that includes a slot 62. The slot 62 of the first latch member 60 cooperates with a second latch member (see FIG. 1B) to secure the trigger guard 30 in a closed position (not shown). However, in FIG. 1A, the trigger guard 30 is shown in an open position.

Figure 1B:
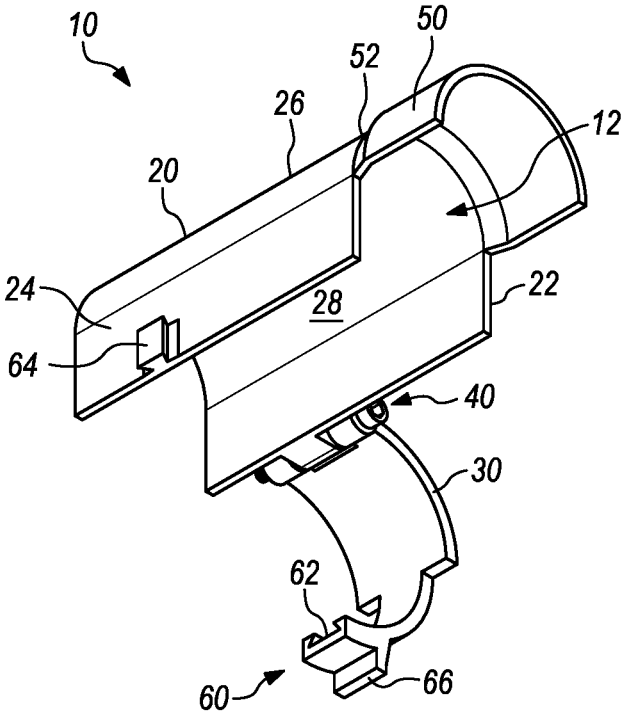
FIG. 1B is a bottom-angled, left-hand side perspective view of the apparatus.

FIG. 1B is a bottom-angled, left-hand side perspective view of the apparatus 10. In this view the open channel 12 is more clearly shown. The open channel 12 is defined by the inside surfaces of the cover 20, including the inside surface of the first (right-hand) side 22, the inside surface of the second (left-hand) side 24, and the inside surface of the curved top portion 26.

The wrist guard 50 extends from the curved top portion 26 of the cover 20 in a proximal direction with an optional flared neck 52 allowing the wrist guard 50 to have a larger dimension and/or different shape than the cover 20.

The second side 24 forms or secured the second latch member 64. In the illustrated embodiment, the second latch member 64 is a dovetail/trapezoidal shaped tab that extends laterally outward from the surface of the second side 24. The second latch member 64 has a profile or shape that is receivable in the slot 62 of the first latch member 60 formed at the second end of the trigger guard 30. The alignment and engagement of the first and second latch members is shown in greater detail in reference to FIGS. 3A-D and FIGS. 4A-C. A latch release tab 66 is provided for disengage the slot 62 from the tab 64.

Figure 2A:
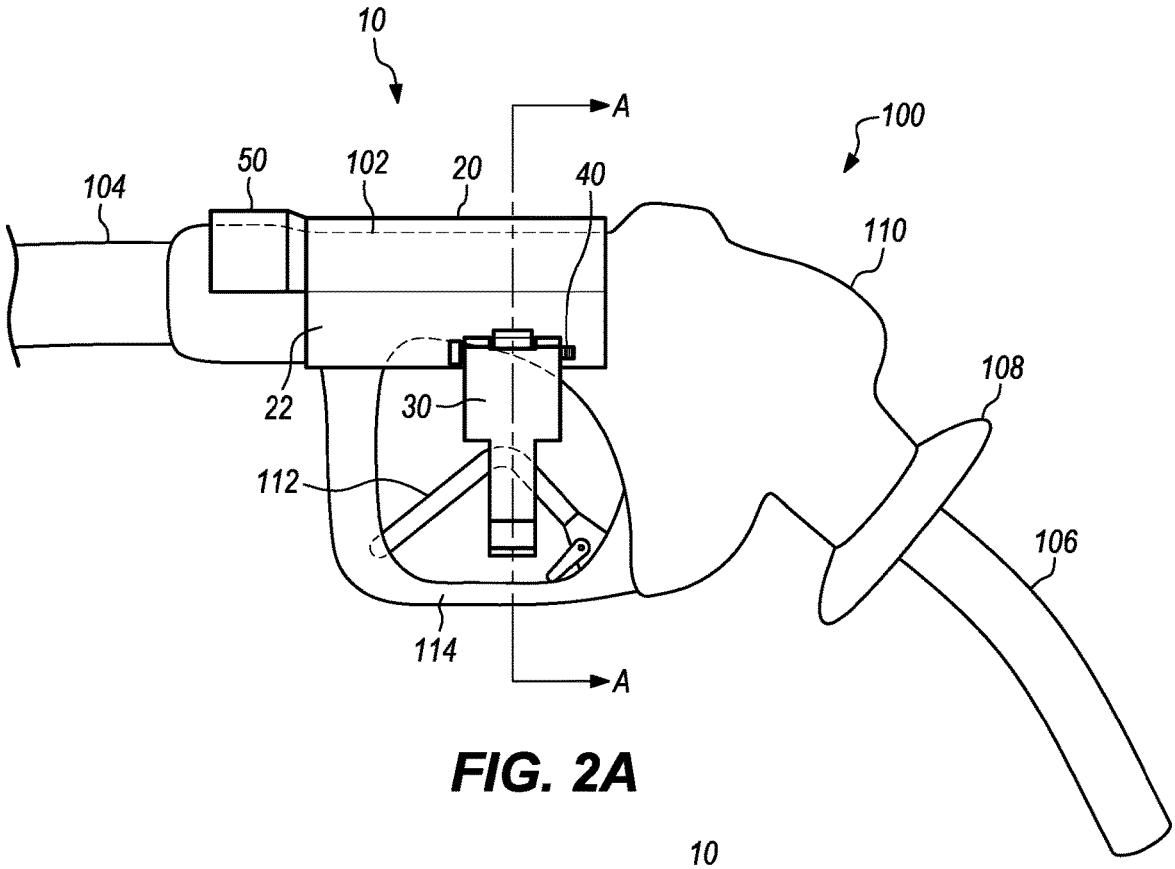
FIG. 2A is a right-hand side view of the apparatus in an open condition and positioned over a fuel pump handle of a fuel pump nozzle.

FIG. 2A is a right-hand side view of the apparatus 10 in an open condition and positioned over a fuel pump handle 102 of a fuel pump nozzle 100. For context, the fuel pump nozzle 100 further includes a fuel delivery hose 104 extending from the fuel pump (not shown), a fuel dispensing tube 106, a vapor seal or vapor recovery flange 108, a plastic valve cover 110, and a fuel trigger 112. The cover 20 has been placed over the fuel pump handle 102 until the inside surface of the cover 20 contacts the fuel pump handle 102. The wrist guard 50 extends from the proximal end of the cover 20 toward the fuel deliver hose 104.

Notice that the trigger guard 30 is hanging down from the hinge 40 as was shown in FIGS. 1A-B, and that the fuel trigger 112 is in a resting position where no fuel is being dispensed from the fuel pump nozzle 100. In this position, the second (lower/distal) end of the trigger guard 30 reaches a point that is lower than the fuel trigger 112. Accordingly, upon rotation of the trigger guard 30 (into the page as shown in FIG. 2A), the second end of the trigger guard 30 will extend through a gap between the fuel trigger 112 and a lower frame member 114 of the fuel pump nozzle 100.

Figure 2B:
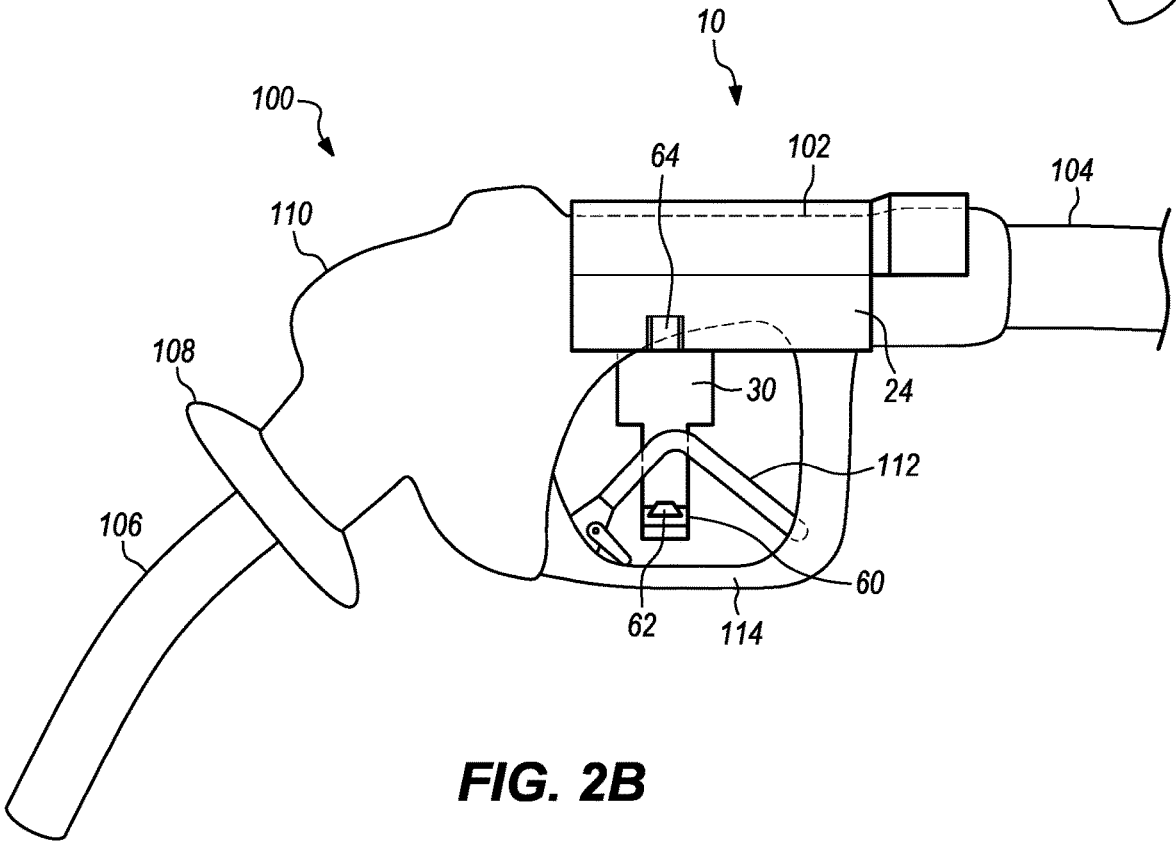
FIG. 2B is a left-hand side view of the apparatus in the open condition and positioned over the fuel pump handle.

FIG. 2B is a left-hand side view of the apparatus 10 in the open condition and positioned over the fuel pump handle as shown in FIG. 2A. However, the second side 24 shows the second latch member 64 positioned for engagement and connection with the first latch member 60. Specifically, the second latch member 64 is in the form of a dovetail-shaped tab and the first latch member 60 includes a dovetail-shaped slot 62 that can engage and grip the tab.

Again, notice that the trigger guard 30 is hanging down from the hinge 40 (not shown), and that the fuel trigger 112 is in a resting position where no fuel is being dispensed from the fuel pump nozzle 100. In this position, the second (lower/distal) end of the trigger guard 30 reaches a point that is lower than the fuel trigger 112. Accordingly, upon rotation of the trigger guard 30 (out of the page as shown in FIG. 2A), the second end of the trigger guard 30 will extend through the gap between the fuel trigger 112 and the lower frame member 114 of the fuel pump nozzle 100.

Figure 2C:
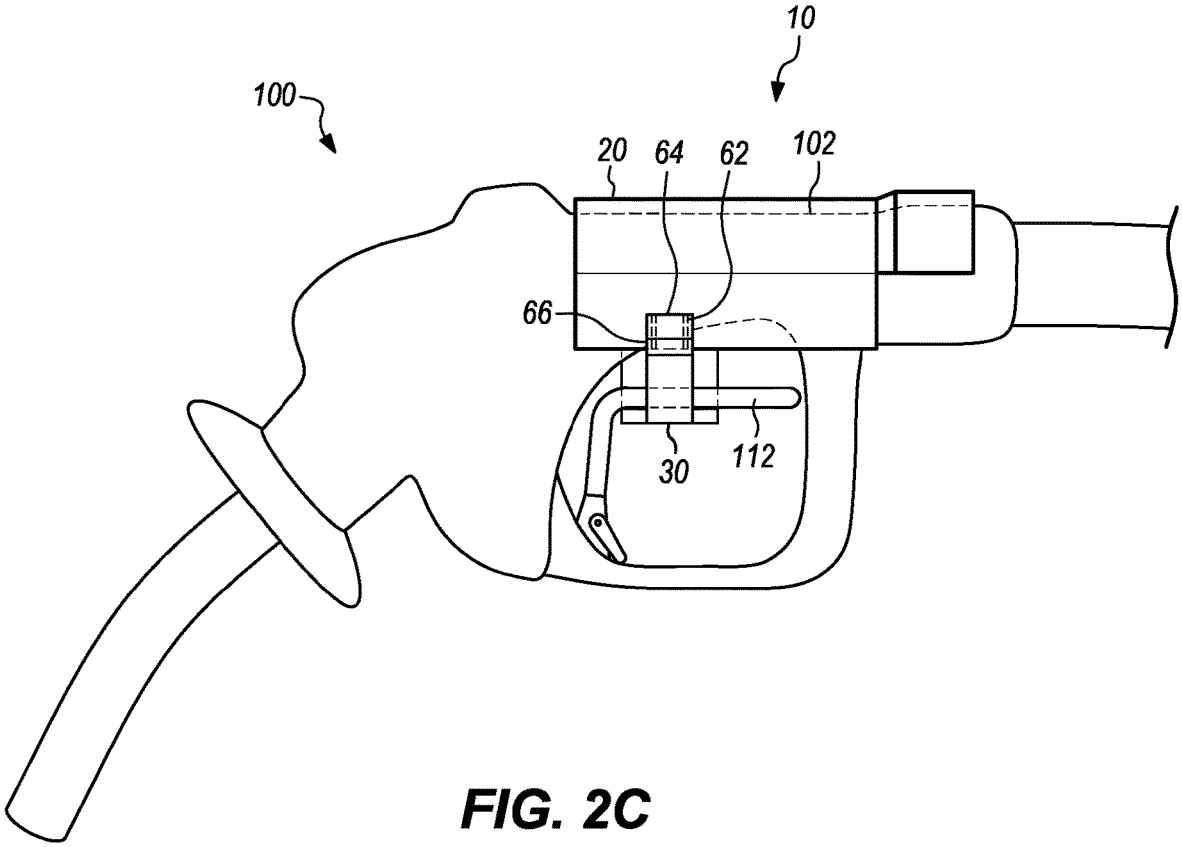
FIG. 2C is left-hand side view of the apparatus in a closed condition about the fuel pump handle and fuel pump trigger.

FIG. 2C is left-hand side view of the apparatus 10 (similar to FIG. 2B) in a closed condition about the fuel pump handle 102 and fuel trigger 112. Relative to FIG. 2B, the trigger guard 30 has been rotated to lift the fuel trigger 112 and engage the first latch member (slot) 62 about the second latch member (tab) 64. To make this happen, an individual's palm would press against the top of the cover 20 and their finger(s) would wrap around the trigger guard 30 and lift up on the trigger guard 30. Although the width of the trigger guard 30 is illustrated as being about wide enough (left and right as shown in FIG. 2C) for two fingers, the trigger guard 30 may be as wide as the gap between the fuel trigger 112 and the lower frame member 114 of the fuel pump nozzle 100. Accordingly, the trigger guard 30 may be wide enough to accommodate four fingers, which may be preferred to achieve lifting of the trigger guard 30, actuation of the fuel trigger 112, and engagement of the slot 62 with tab 64.

In the closed position shown, the individual may remove their hand from the apparatus 10 and the fuel pump nozzle 100 may continue to dispense fuel. However, when the fuel pump nozzle 100 senses a full tank, the fuel pump nozzle will automatically shut off and release the fuel trigger 112. Accordingly, after returning the fuel pump nozzle 100 to a stowed position on the fuel pump (not shown), the individual may then use their thumb or other hand to press down on the latch release tab 66.

Figure 3A:
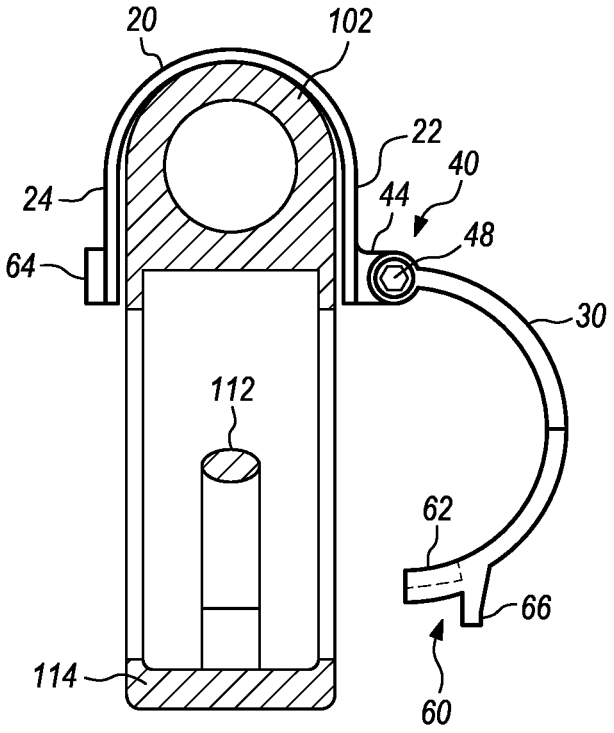
FIGS. 3A-D are cross-sectional views of the apparatus taken along line A-A of FIG. 2A with the trigger guard in an open condition (FIG. 3A), a first intermediate position (FIG. 3B), a second intermediate position (FIG. 3C), and a closed condition (FIG. 3D).
Figure 3B:
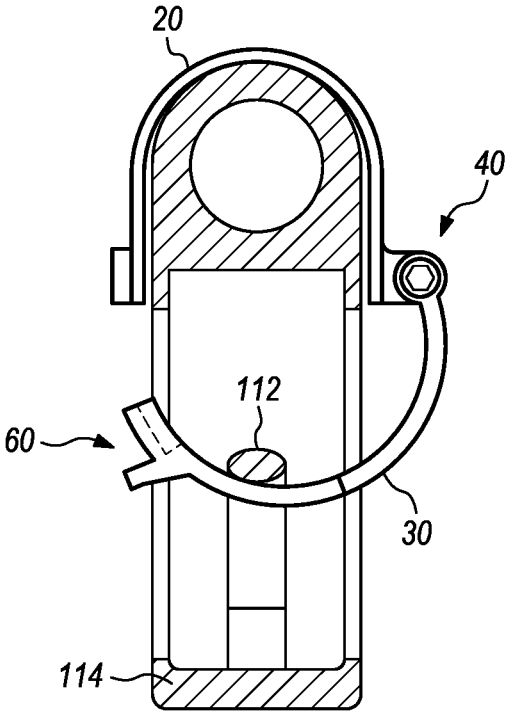
Figure 3C:
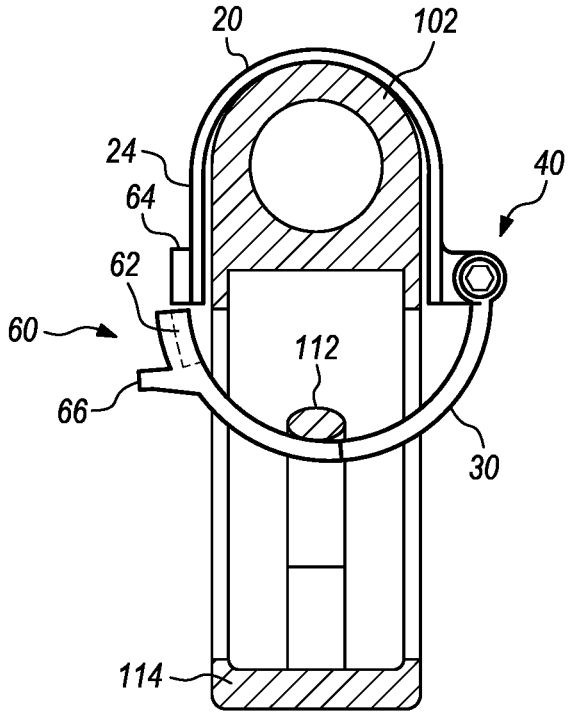
Figure 3D:
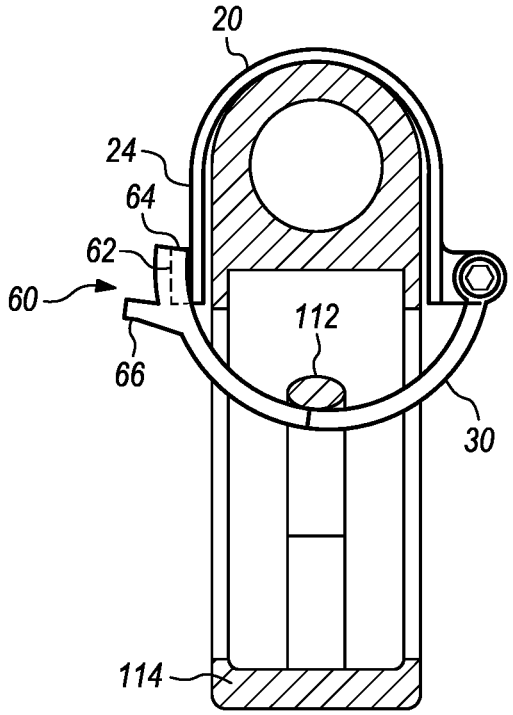

FIGS. 3A-D are cross-sectional views of the apparatus 10 taken along line A-A of FIG. 2A with the trigger guard 30 in an open condition (FIG. 3A), a first intermediate position (FIG. 3B), a second intermediate position (FIG. 3C), and a closed condition (FIG. 3D). In FIG. 3A, the trigger guard 30 is in a fully open condition, which allows the cover 20 to be place over the fuel nozzle handle 102. The cover 20 may held in this position with the palm of an individual's hand, but the cover 20 may also fit closely about the fuel nozzle handle 102 to resist twisting and sliding. In FIG. 3B, the trigger guard 30 has been rotated about the hinge 40 so that the second end has moved under and engaged the fuel trigger 112. Specifically, the second end of the trigger guard 30, which end includes the second latch member 60, passes through the gap between the fuel trigger 112 and the frame member 114. In FIG. 3C, the trigger guard 30 has been further rotated so that the fuel trigger 112 is partially actuated so that the fuel nozzle 100 begins to dispense fuel. Notice also that the first latch member (slot) 62 is approaching the second latch member (tab) 64 and is aligned for coupling upon further rotation. In FIG. 3D, the fuel trigger 30 has been further actuated and the second end of the trigger guard 30 is now coupled or latched to the second side 24 of the cover 20. With frictional engagement and/or other type of engagement between the first latch member (slot) 62 is approaching the second latch member (tab) 64, the individual may let go of their grip around the apparatus 10 and the apparatus 10 will retain the fuel trigger 112 in the actuated position so that the fuel nozzle will continue to dispense fuel.

Figure 4A:
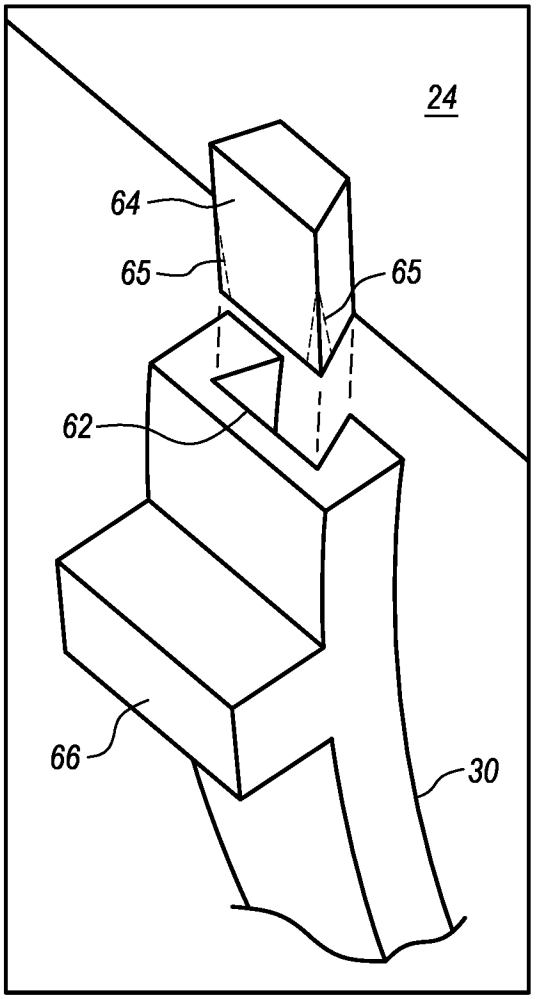
FIGS. 4A-C are perspective views a slot in an end of the trigger guard and a tab on the side of the cover in alignment (FIG. 4A), in partial engagement (FIG. 4B), and full engagement (FIG. 4C).
Figure 4B:
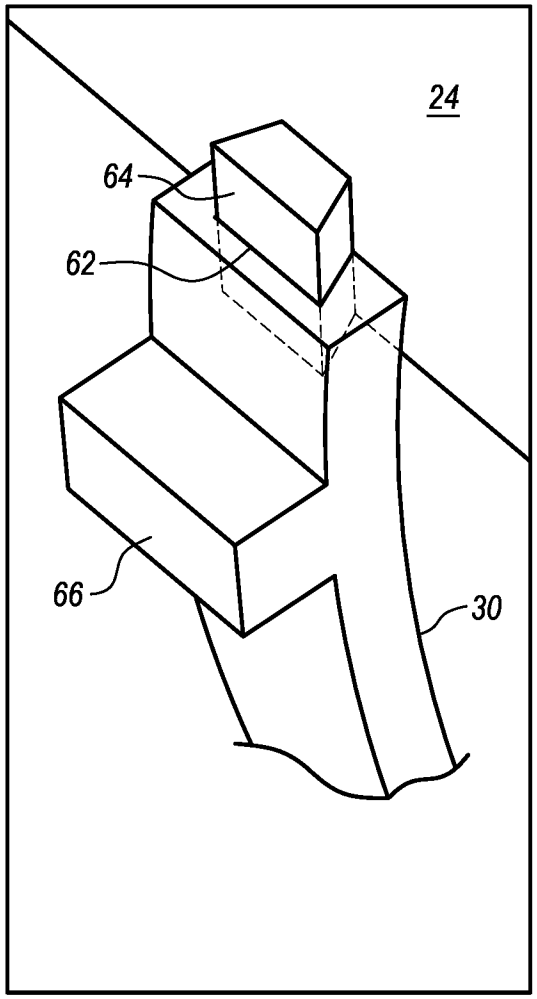
Figure 4C:
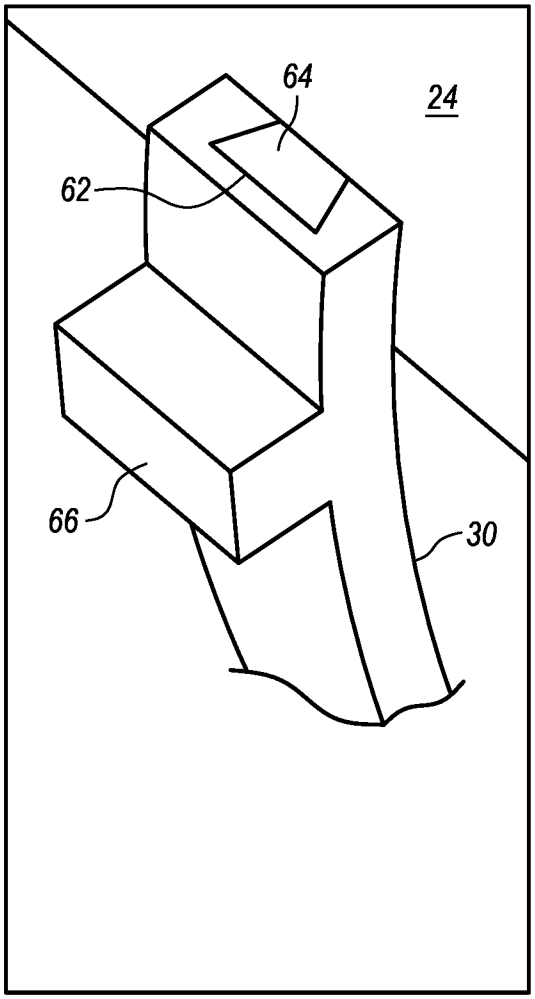

FIGS. 4A-C are perspective views a slot 62 (first latch member) in an end of the trigger guard 30 and a tab 64 (second latch member) on the side of the cover in alignment (FIG. 4A), in partial engagement (FIG. 4B), and full engagement (FIG. 4C). In FIG. 4A, the alignment of the slot 62 and the tab 64 means that further rotation of the trigger guard 30 about the hinge 40 (not shown) will lead to engagement. Note that any one or more of the lower edges of the tab 64 may be tapered (see, for example, tapered lines 65) to facilitate engagement with the slot 62 even with minor misalignment. The tapered edges may extend along the entire leading edge of the tab 64 or any portion thereof. In FIG. 4B, the further rotation of the trigger guard 30 about the hinge 40 (not shown) has caused partial engagement of the slot 62 about the tab 64. In FIG. 4C, still further rotation of the trigger guard 30 about the hinge 40 (not shown) has caused full engagement of the slot 62 about the tab 64. In this position, the frictional engagement between the slot 62 and tab 64 is at its greatest. Furthermore, proper selection of dimensional tolerances, materials of construction and surface treatments may be result in sufficient friction to hold the trigger guard 30 in this closed position while holding the fuel trigger 112 in the actuated position as shown in FIGS. 2A and 3D.

The apparatus may be used by individuals at standard fuel pumps, allowing them to operate the pump and fuel their vehicle without directly touching the fuel pump. Accordingly, the apparatus may be used in a manner to ensure sanitary operation of the fuel pump to prevent transmission of biological and chemical contaminates from the pump to the user's hand. The apparatus functions as an attachable and removable apparatus that fits over the top of a standard fuel pump handle to protect the user's palm. The user can then close a trigger guard that will allow them to pull the fuel trigger to begin dispensing fuel without touching the fuel trigger, protecting their fingers from contamination. This trigger guard may be latched onto the other side of the cover to form an enclosed ring around the fuel pump handle and fuel trigger. This feature also allows the individual dispense fuel hands free, just as they would be able to normally.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. An apparatus, comprising:

a cover forming an open channel that includes a curved grip portion and first and second sides extending from the curved grip portion, wherein the open channel receives a fuel pump handle of a fuel pump nozzle such that the curved grip portion fits closely over a top surface of the fuel pump handle and the first and second sides extend downwardly along opposing sides of the fuel pump handle; and a trigger guard including a first end that is connected to the first side of the cover by a hinge and a second end that is selectively connectable to the second side of the cover, wherein the trigger guard is rotatable about the hinge from an open position in which the second end is disconnected from the second side to a closed position in which the trigger guard extends under a fuel pump trigger of the fuel pump nozzle and the second end is connected to the second side.

2. The apparatus of claim 1, wherein the second end of the trigger guard includes a first latch member and the second side of the cover includes a second latch member, wherein the first and second latch members selectively connect the second end of the trigger guard to the second side of the cover.

3. The apparatus of claim 2, wherein the cover and trigger guard are rigid, and wherein rotating the trigger guard about the hinge from the open position toward the closed position aligns the first latch member with the second latch member for engagement therebetween.

4. The apparatus of claim 3, wherein the first latch member is a slot formed in the second end of the trigger guard and the second latch member is a tab formed on the second side of the cover, and wherein the slot is selectively connectable to the tab by slidably engaging the slot about the tab.

5. The apparatus of claim 4, wherein engagement of the slot about the tab causes static friction between the slot and tab to resist disengagement of the second end of the trigger guard from the second side of the cover.

6. The apparatus of claim 5, wherein an amount of the static friction between the slot and the tab is sufficient to secure the trigger guard in a closed position during hands-free operation of the fuel pump nozzle, yet the amount of the static friction between the slot and the tab is overcome by a force of the fuel pump trigger being released in response to the fuel pump nozzle being automatically shut off.

7. The apparatus of claim 5, wherein the slot and tab have complementary dovetail shapes.

8. The apparatus of claim 2, wherein the second end of the trigger guard further includes a latch release tab that extends laterally away from the fuel pump nozzle with the trigger guard in the closed position.

9. The apparatus of claim 8, wherein the latch release tab is positioned for operation with a user's thumb when the user is gripping the cover.

10. The apparatus of claim 1, characterized in that a user may temporarily position the cover over the fuel pump handle and cause the trigger guard to actuate the fuel pump trigger without touching any portion of the fuel pump handle and the fuel pump trigger.

11. The apparatus of claim 10, characterized in that the user may remove the cover from the fuel pump handle with the trigger guard in the open position.

12. The apparatus of claim 1, characterized in that a user may, with a single hand, position the cover over the fuel pump handle and cause the trigger guard to actuate the fuel pump trigger without touching any portion of the fuel pump handle and the fuel pump trigger.

13. The apparatus of claim 1, further comprising:

a rigid wrist guard extending from a proximal end of the cover and covering a portion of the fuel pump nozzle that is proximal of the fuel pump handle.

14. The apparatus of claim 1, wherein the cover has an outward directed surface that is textured to improve a grip of a user's hand on the rigid cover.

15. The apparatus of claim 1, wherein the open channel is a substantially U-shaped channel.

16. The apparatus of claim 1, wherein cover and trigger guard are made with plastic.

17. The apparatus of claim 16, wherein the plastic is a polyester.

18. The apparatus of claim 1, wherein the open channel has an interior surface that is complementary to the top surface of the fuel pump handle.

19. An apparatus, comprising:

a cover forming an open channel that includes a curved grip portion and first and second sides extending from the curved grip portion, wherein the open channel receives a fuel pump handle of a fuel pump nozzle such that the curved grip portion fits closely over a top surface of the fuel pump handle and the first and second sides extend downwardly along opposing sides of the fuel pump handle; and a trigger guard including a first end that is connected to the first side of the cover by a hinge and a second end that is selectively connectable to the second side of the cover, wherein the trigger guard is rotatable about the hinge from an open position in which the second end is disconnected from the second side to a closed position in which the trigger guard extends under a fuel pump trigger of the fuel pump nozzle and the second end is connected to the second side;

wherein the second end of the trigger guard includes a first latch member and the second side of the cover includes a second latch member, wherein the first and second latch members selectively connect the second end of the trigger guard to the second side of the cover, and wherein the first and second latch members disconnect under a force of the fuel pump trigger being released in response to the fuel pump nozzle being automatically shut off.

20. The apparatus of claim 1, characterized in that a user may, without touching any portion of the fuel pump handle and the fuel pump trigger, temporarily position the cover over the fuel pump handle, cause the trigger guard to actuate the fuel pump trigger, and remove the cover from the fuel pump handle with the trigger guard in the open position.

* * * * *